United States Patent [19]

Masuda et al.

[11] Patent Number: 4,986,341

[45] Date of Patent: Jan. 22, 1991

[54] PROCESS FOR MAKING NON-ORIENTED HIGH SILICON STEEL SHEET

[75] Inventors: Sadakazu Masuda; Fumio Fujita; Masamoto Kamata; Masahiko Yoshini; Takashi Ariizumi; Yuji Okami; Yoshikazu Takada; Junichi Inagaki, all of Tokyo, Japan

[73] Assignee: Nippon Kokan Kabushiki Kaisha, Tokyo, Japan

[21] Appl. No.: 294,664

[22] PCT Filed: May 23, 1988

[86] PCT No.: PCT/JP88/00488

§ 371 Date: Dec. 15, 1988

§ 102(e) Date: Dec. 15, 1988

[51] Int. Cl.[5] ..... B22D 11/00

[52] U.S. Cl. ..... 164/477; 148/2; 148/111

[58] Field of Search ..... 164/476, 477, 76.1; 29/527.5, 527.7; 148/2, 111

[56] References Cited

U.S. PATENT DOCUMENTS

| | | | |
|---|---|---|---|
| 4,331,196 | 5/1982 | Ohashi | 164/476 |
| 4,588,453 | 5/1986 | Shimizu et al. | 148/111 |
| 4,715,905 | 12/1987 | Nakaota et al. | 164/476 |
| 4,766,947 | 8/1988 | Shibuya et al. | 29/527.7 |
| 4,773,948 | 9/1988 | Nakaoka et al. | 148/111 |

FOREIGN PATENT DOCUMENTS

| | | | |
|---|---|---|---|
| 49930 | 4/1979 | Japan | 164/476 |
| 134519 | 8/1982 | Japan | 148/111 |
| 96219 | 6/1984 | Japan | 164/477 |
| 123715 | 7/1984 | Japan | 148/111 |
| 125325 | 7/1985 | Japan | 148/111 |
| 1084327 | 4/1986 | Japan | 148/111 |
| 86/02102 | 4/1986 | World Int. Prop. O. | 164/476 |

*Primary Examiner*—Richard K. Seidel
*Assistant Examiner*—Edward A. Brown
*Attorney, Agent, or Firm*—Henry C. Nields

[57] ABSTRACT

The present invention relates to a process for making non-oriented high Si steel sheet without problems during the sequence from the step of making molten steel to the step of rolling to final sheet thickness. An ingot (or a continuously cast piece) of high Si steel (containing 4.0 to 7.0% Si and specified with Al, Mn, C and P) is subjected to slabbing-hot rolling (or else directly slab rolling-hot rolling) and subsequently the hot rolled steel is reduced to thin thickness. The steel material is maintained at temperature of more than a determined temperature from the step of making molten steel to the step of hot rolling. In the step of hot rolling, information regarding finish rolling conditions and coiling conditions is used to provide structure suitable for the subsequent thin rolling. The hot rolled steel is then warm-rolled to the required thickness.

8 Claims, 6 Drawing Sheets

PROCESS FOR MAKING NON-ORIENTED HIGH SILICON STEEL SHEET

TECHNICAL FIELD

The present invention relates to a method for making non-oriented high Si steel sheets.

BACKGROUND OF THE INVENTION

Less than 4% Si steels are classified into grain oriented Si steels and non-oriented steels in accordance with the producing practices, and are processed to laminated iron cores or coiled iron cores for electromagnetic induction devices, or magnetic shielding cases.

Recently, from the standpoint of saving natural sources and energy, small sizes and high efficiency electromagnetic or electronic parts have been demanded, and soft magnetic properties, especially in Si steel sheets having excellent iron loss properties, have been also required. It is known that soft magnetic properties of Si steel sheets are improved with increasing additions of Si and exhibit the maximum permeability at about 6.5 wt %, and since natural electric resistance is high, the iron loss is made small.

In this kind of steel sheets, if Si content is more than 4.0 wt %, workability is abruptly worsened, and therefore it has been impossible to produce high Si steel sheets in industrial scales by the rolling process.

Many patents and literatures teach the rolling of high Si steels. Those almost always refer to steel materials of below 4.0 wt %, or if some of them describe Si content of above 4.0 wt %, such descriptions seem to be analogized from materials of about 3 wt %. Upon the inventors' many experiments and investigations made on materials of around 6.5 wt %, it was found that high Si steel sheets as 6.5 wt % could not be produced by the above taught procedures of the prior art.

Productions of Si steel sheets are disclosed, for example, in Laid-Open Japanese Patent Application Nos. 29496/76, 36968/82 or 181822/83, but those deal with materials of lower than 4.0 wt % and could not be applied to Si steels of around 6.5 wt % because workability is abruptly dropped with increasing of Si content.

It is known that the rollings are carried out on brittle materials or materials with high deformation resistance not by the cold working but by increasing the temperature. The greatest problem with producing high Si thin steel sheets is how to avoid troubles caused by crackings in each of the producing steps and how accomplish a stable total process. Satisfactory results could not be obtained by merely heightening the temperature.

The inventors developed studies about productions by rolling high Si thin steel sheets of more than 4.0 wt % Si content. In the course of their studies, it was found that the productions by rolling had the following problems.

(1) During cooling while transferring the steel ingot, slab, or continuously cast slab, thermal stress cracks are generated due to difference in temperature between the surface and the interior.

(2) Since the processability is largely changed by the processing degree of the material, i.e., the structure, rolling cracks would be generated unless the rolling temperatures were selected properly.

(3) Unless the coiling temperatures were selected properly, the coil would be broken when the temperature is low, and when the temperature is high deformation in a next rolling would be worsened considerably by recrystallization of the coiled steel.

Through further studies in reference to the above problems, it was found that the problems (1) to (3) were improved and that high Si steel sheets could be produced stably without inviting problems from making the molten steel into the final thickness.

DISCLOSURE OF THE INVENTION

A first invention comprises, making an ingot or continuously casting piece of high Si steel composed of Si: 4.0 to 7.0 wt %, Al: not more than 2 wt %, Mn: not more than 0.5 wt %, C: not more than 0.2 wt %, P: not more than 0.1 wt %, and the rest being iron and inavoidable impurities;

(a) introducing a solidified ingot or a continuously cast piece into a slab heating furnace until the lowest-temperature part thereof becomes not less than 600° C., heating it at temperature of not more than 1250° C. therein and rolling the slab; or (b) directly transferring a solidified ingot or a continuously cast piece into a slabbing process while the lowest-temperature part thereof is becomes not less than 600° C.; after rolling the slab at temperature of not less than 600° C., (i) introducing the slab into a hot rolling furnace until the lowest-temperature part thereof becomes not less than 400° C., and sending the slab to the hot rolling process; or (ii) directly transferring the slab to the hot rolling process while the lowest-temperature part thereof is not less than 400° C.;

in the hot rolling, finish-rolling the slab such that total rolling reduction at temperature of not more than 900° C. is more than 30%, coiling the hot rolled steel at temperature between 300° C. and 700° C., and rolling the hot rolled coil by a reverse mill at temperature of not more than 400° C. to thickness of not more than 0.5 mm.

A second invention comprises, continuously casting piece of high Si steel composed of Si: 4.0 to 7.0 wt %, Al: not more than 2 wt %, Mn: not more than 0.5 wt %, C: not more than 0.2 wt %, P: not more than 0.1 wt %, and the rest being iron and inavoidable impurities (a) introducing a solidified cast piece into a roll heating furnace until the lowest-temperature part thereof becomes not less than 600° C., and sending the heated piece to a hot rolling process; or (b) directly transferring the solidified cast piece to the hot rolling process while the lowest-temperature part thereof is not less than 600° C.

in the hot rolling, finish-rolling the piece such that total rolling reduction at temperature of not more than 900° C. is more than 30%, coiling the hot rolled steel at temperature between 300° C. and 700° C., and rolling the hot rolled coil by a reverse mill at temperature of not more than 400° C. to thickness of not more than 0.5 mm.

MOST PREFERRED EMBODIMENT FOR PRACTISING THE INVENTION

Steel composition of the invention has been limited for under mentioned reasons.

Si is an element for improving soft magnetic properties as said above, the best effect of which is exhibited around 6.5 wt %. The invention determines Si content at 4.0 to 7.0 wt %. If it were less than 4.0 wt %, the cold rolling property would be hardly a problem, and if it were more than 7.0 wt %, the soft magnetic property would be deteriorated as increasing of magnetic strain or lowerings of saturated magnetic flux density and maximum permeability, so that the cold rolling property is worsened considerably.

Al is added for deoxidizing the molten steel. It fixes solute N which deteriorates the soft magnetic property, and increases electric resistance by making solute Al in the steel. But much Al spoils the workability and invites cost-up. Thus, it is not more than 2 wt %.

Mn fixes S being impurity. Since much Mn worsens the workability and much MnS gives bad influence to the soft magnetic property, it is not more than 0.5 wt %.

P is added for decreasing iron loss. Since much P worsens the workability, it is not more than 0.1 wt %.

C is a halmful element which increases iron loss in the product and causes magnetic aging, and lowers the workability. So, it is not more than 0.2 wt %.

A further reference will be made to the rolling conditions.

The inventors made studies on the structure and the workability of high Si steel by the experiments.

Figure 1:
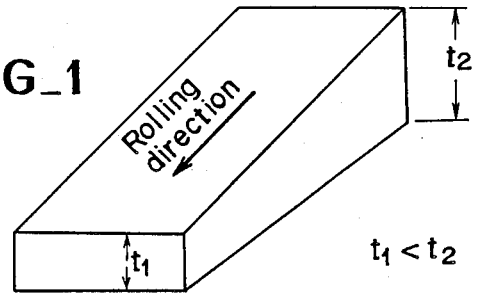
FIG. 1 shows a taper rolled test piece for a taper rolling test.
Figure 2:
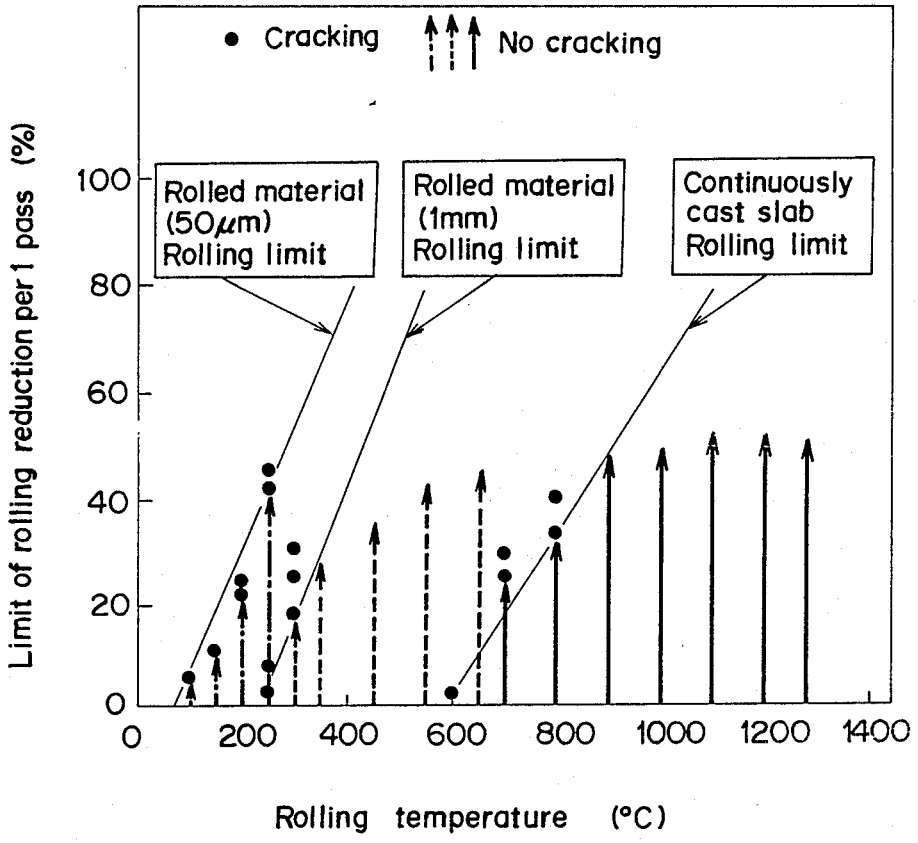
FIG. 2 shows roll deforming properties of 6.5 wt % Si steels by the taper rolling test in relationship between rolling temperatures and limited rolling reduction per 1 pass.

The 6.5 wt % Si steel was evaluated with respect to the rolling workability by the taper rolling test in the test piece as shown in FIG. 1. FIG. 2 shows the results which teach clearly characteristics of the rolling workability as follows.

(1) In the material of cast structure, the workability is very preferable more than 900° C., but it is deteriorated linearly lower than 900° C., and the rolling is almost impossible about 600° C.

(2) In the material where the roughing was done in the slabbing or the hot rolling, and structure was refined by deforming-recrystallization, or where spaces between grain boundaries in thickness were made small by the above rollings, the processing limits are more expanded in dependence upon the spaces in the grain boundaries than the materials of cast structure. That is, the rolling deformation of the rolled material of 1 mm grain diameter is lost at about 250° C., and that of 50 μm grain diameter is lost at about 80° C. Ordinary rolling deformations are well available at the temperatures higher than the above ranges. The grain diameters of the rolled slabs are 1 to 3 mm ordinarily, taking into consdieration grain growth by recrystallization in the heating furnace. The continuously cast slab is refined about 1 mm after the hot rolling and the roughing. In any case, the spaces in thickness of the grain boundaries can be made about 50 μm nearly the final pass of the hot rolling.

The slabbing has problems of thermal stress crackings at cooling the ingot, aside from the problem about the above stated rolling deformation.

Figure 3:
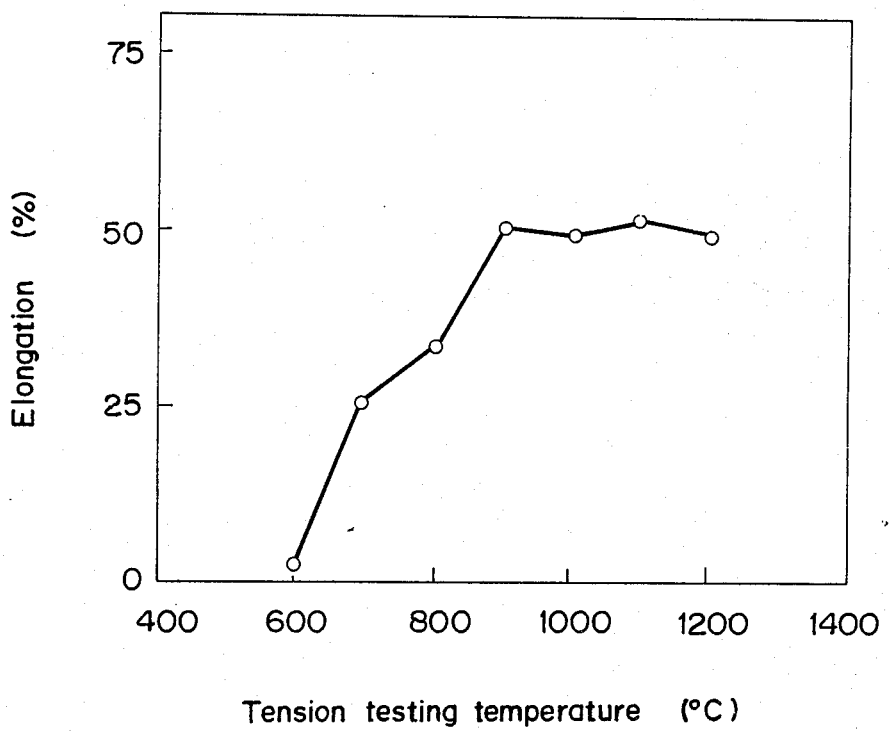
FIG. 3 shows relationship between tension testing temperature and elongation of 6.5 wt % Si ingot.
Figure 4:
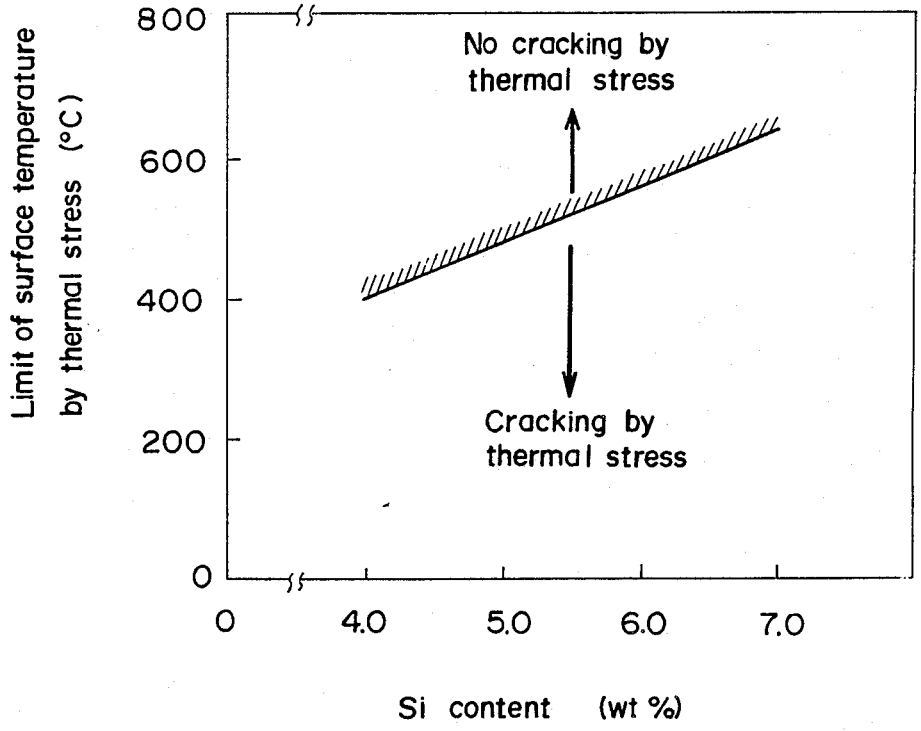
FIG. 4 shows limit temperatures of thermal stress cracking of high Si steel ingot in relation with Si contents.

With respect to the thermal stress crackings at cooling the steel ingots of 4.0 to 7.0 wt % Si, the basic tension test of the ingot (FIG. 3) was made, and further a practical ingot was left in the air and the results were as in FIG. 4. In the results, when the ingot surface temperature in response to Si contents was lower than the determined value, the thermal stress crack was generated due to tension made by the difference in temperature between the surface and the interior, since the plastic deforming ability is worsened as shown in FIG. 3. The ingot may be avoided from the thermal stress crack by maintaining the surface temperature at about 600° C. When the same experiment was made on the slab, it was given large influence of the structure, and if the surface temperature (the part at the lowest temperature) is maintained above 400° C., the thermal stress cracks can be avoided.

Figure 5:
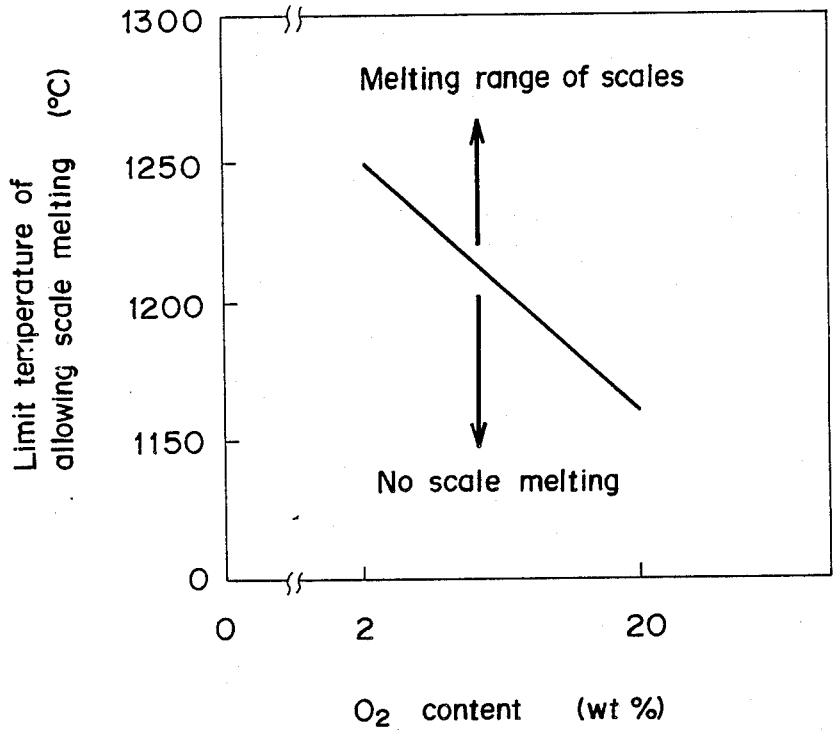
FIG. 5 shows allowable limit temperatures of melting scales of high Si steels in relation with oxygen contents in atmosphere of a soaking furnace.

The heating of the slab is involved about problems as follows. When the high Si steel sheet is maintained more than the determined temperature, scales are formed and when the temperature is higher than a certain degree, FeO and $SiO_2$ in the scale cause eutectic reaction and are molten (forming of fayalite). The inventors made experiments on that the oxygen contents in the heating furnace were variously changed so as to study the heating temperature ranges where the scale was not molten with respect to the high Si steels as 4.0 to 7.5 wt %. FIG. 5 shows the results of the studies from which it is seen that the oxygen concentration could be controlled till about 2 wt % in the ordinarily used heating furnace, and if the heating temperature is decreased below 1250° C., the scale could be exactly avoided from melting.

The structure of the hot rolled coil gives big influence to the workability of rolling the thin sheet. Behaviours of the recrystallization of the high Si steel sheet depend upon the working degree, the temperatures and the maintaining time. After the hot rolling (coil of about 2 mm$^{\ell}$), the grain grow due to recrystallization by maintaining more than 700° C. for a certain time, and deteriorates the workability of rolling the thin sheet in a next step. Thus, the coiling temperature should be not more than 700° C. The lower limit should be more than 300° C. for avoiding the coil from breakage by bending strain.

Figure 6:
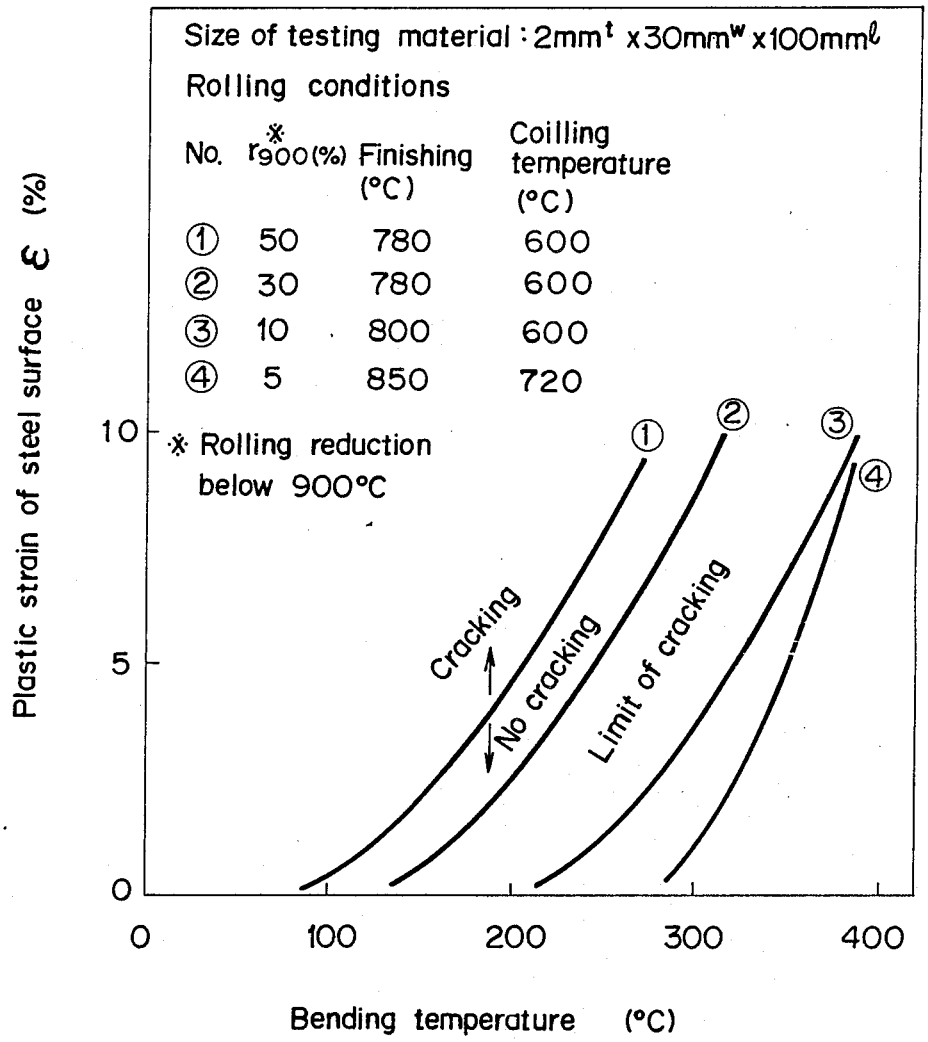
FIG. 6 shows results of triple spot bending test of workability of hot rolled sheet, and cracking limits of the hot rolled sheet in relation between bending temperatures and surface plastic strain.

The workability of the hot rolled sheet produced by changing the hot roll finishing temperature and the pass schedule was studied by a triple spot bending test. FIG. 6 shows one of the results, from which it is seen that the workability of rolling the thin sheet may be more improved by lowering the hot roll finishing temperatures and increasing rolling strain at the low temperature range, than recrystallization of the hot rolling finish pass and behaviours in growth of aggregate structure. Many experiments made by the inventors teach that the workability of rolling the thin sheet was improved by increasing the total rolling reduction more than 30% at the temperature of below 900° C. in the finishing rolling.

The hot roll finishing conditions accomplish improvement of the workability of rolling the thin sheet in the subsequent step, i.e., actually lowering of the warm rolling temperature, and increasing of rolling reduction of 1 pass.

Since the materials to be dealt with by the invention are the brittle materials, the warm rolling is of cource necessary. The rolling temperature is desirable to be not more than 400° C., taking into consideration the surface property of the rolled material, the lubricant and accompanied facilities of the rolling machine (e.g., heating apparatus), and the rolling at the low temperature is advantageous in production cost.

The thin sheet is rolled by the reverse mill and the rolling could be carried out effectively to thickness of below 0.5 mm, and as recovery treatment could be dealt with between the passes, the high Si steel sheets having satisfactory magnetic properties could be produced.

Figure 7:
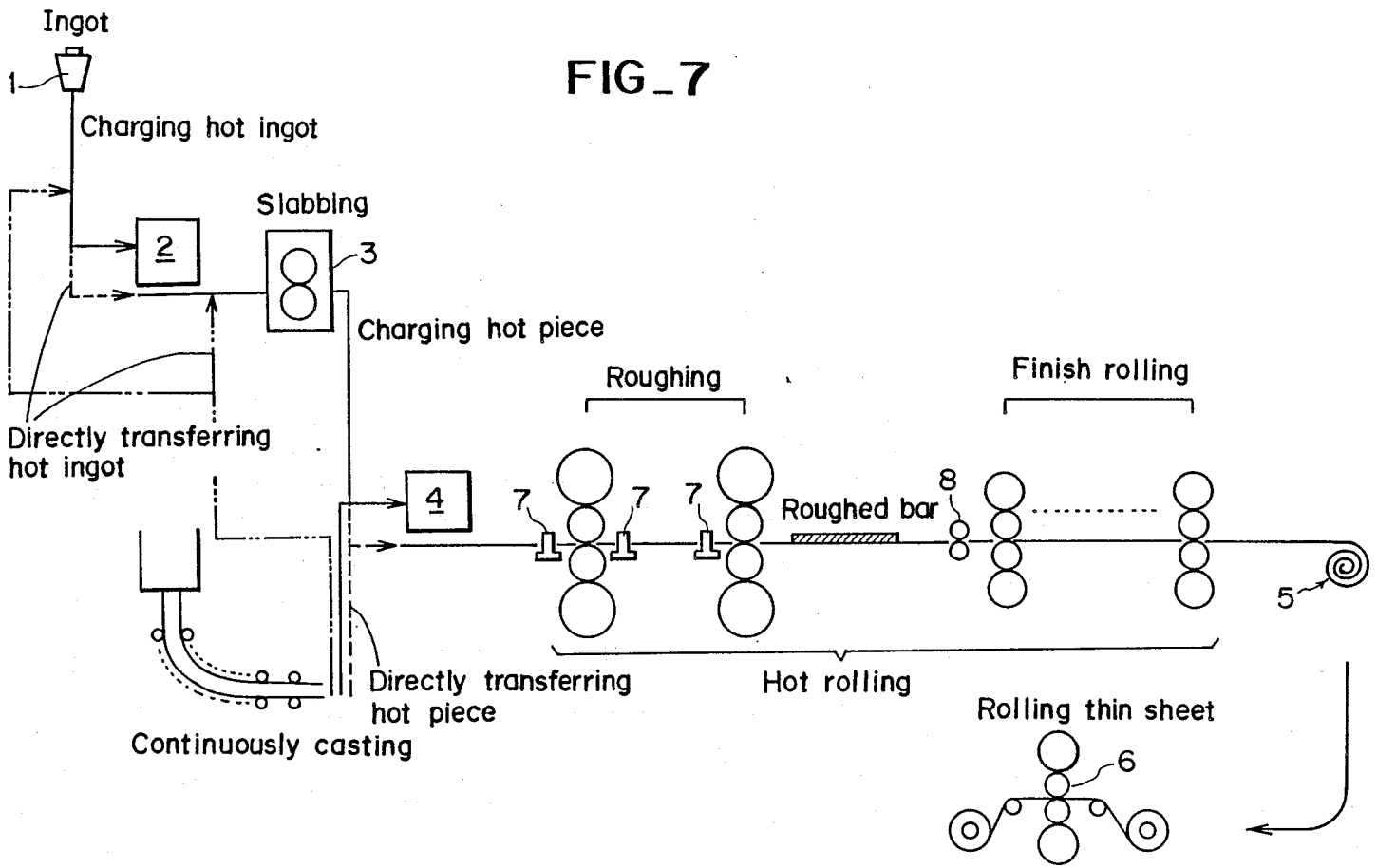
FIG. 7 shows one example of production flows of the present invention.

FIG. 7 shows one example of the production flows, and an explanation will be made referring to this example.

In the case of the ingot, the solidified ingot 1 is introduced into a slab heating furnace 2 until the lowest-temperature part thereof becomes not less than 600° C., heated to a temperature of not more than 1250° C., and slabbed by a slab rolling machine 3. If required, the ingot 1 may be directly transferred to the slabbing process (directly sending the hot ingot), instead of introducing it to the slab heating furnace 2, while the lowest-temperature part thereof becomes not less than 600° C. The slabbing is done at a temperature of more than 600° C.

The rolled slab is introduced into a roll heating furnace 4 until the lowest-temperature part thereof becomes not less than 400° C., heated to a temperature of not more than 1250° C., and sent to the hot rolling process. If required, the slab may be directly transferred to the hot rolling process, instead of introducing the slab to the roll heating furnace 2, until the lowest-temperature part thereof becomes not less than 400° C.

In the case of the continuously cast piece, there are two practices: either (1) the hot rolling is carried out after slabbing the cast piece, or (2) the cast piece is sent to the hot rolling (directly sending the hot piece).

The former is performed with the same slabbing and hot rolling as said in the above ingot case.

The latter is performed by introducing the cast piece into a roll heating furnace 4 until of the lowest-temperature part thereof becomes not less than 600° C., heating it to a temperature of not more than 1250° C., and sending it to the hot rolling process. If required, the cast piece may be directly transferred to the hot rolling process instead of introducing it to the heating furnace 4, until the lowest-temperature part becomes not less than 600° C.

The steel material is rolled such that the total rolling reduction at a temperature of not more than 900° C. is more than 30% in the finish rolling (ordinarily above 400° C.), and coiled onto a coiler 5 at a temperature between 300° C. and 700° C.

The hot rolled coil is sent to a rolling facility installed with a reverse mill 6 for rolling the thin sheet, and rolled to thickness of below 0.5 mm at a temperature of not more than 400° C.

In FIG. 7, the numeral 7 designates an edger, and 8 is a crop shear.

EXAMPLE 1

A high Si steel ingot of the chemical composition shown in Table 1 was made, and subjected, following the invention, to slabbing, hot rolling and the warm rolling to a thickness of 0.5 mm. The production conditions were as follows.

TABLE 1

| Steels | Si | Al | Mn | C | P | Balance |
|---|---|---|---|---|---|---|
| (A) | 6.5 | 0.4 | 0.1 | 0.01 | 0.05 | Fe & Impurities |
| (B) | 6.5 | 0.05 | 0.06 | 0.002 | 0.001 | Fe & Impurities |

| | |
|---|---|
| Ingot: | 5 ton |
| Slabbing conditions. | |
| Inserting temperature into heating furnace: | 700° C. (Surface temperature) |
| Soaking temperature: | t C. |
| Rolling temperature (Surface temperature at final pass): | 970° C. |
| Size of slab: | 150 mm (T) × 650 mm (W) × 5000 mm (L) |
| Hot rolling conditions | |
| Inserting temperature into heating furnace: | 700° C. (Surface temperature) |
| Soaking temperature: | 1150° C. |
| Thickness of inlet side when finishing: | 35 mm |
| Rolling temperature | |
| Finish lst pass: | 1000° C. |
| Temperature of outlet side at final finish pass: | 780° C. (Finishing temperature) |
| Total rolling reduction not more than 900° C.: | 50% |
| Finishing size: | 2 $mm^t$ × 650 $mm^w$ |
| Coiling temperature: | 600° C. |
| Rolling of thin sheet | |
| Rolling temperature | 275° C. to 150° C. |
| Finishing size: | 0.5 $mm^t$ × 650 $mm^w$ |

Comparative examples were produced under conditions as follows.

COMPARATIVE EXAMPLE 1

The ingot of the same composition as the invention was left in the air until the surface temperature became 500° C., introduced into the heating furnace, and slabbed under the same heating and rolling conditions as the invention.

COMPARATIVE EXAMPLE 2

The same ingot as the invention was left in the air until it reached room temperature, and then was heated and slabbed.

COMPARATIVE EXAMPLE 3

The same ingot was left in the air until the surface temperature became 150° C., and then was introduced into the heating furnace, and rolled under the same heating and rolling conditions.

COMPARATIVE EXAMPLE 4

The slab produced under the same conditions as those of the invention was (1) heated in the heating furnace, (2) hot rolled under the following conditions: finish 1st pass rolling temperature: 1100° C., final pass: 850° C., coiling temperature: 750° and rolling reduction below 900° C.: 5% and (3) warm rolled.

In Comparative Example 1, the ingot was generated with thermal stress cracks, and the cracks were made larger by the slabbing. A hot rolling slab could not be provided. In Comparative Example 2, since the thermal stress cracks of the ingot were remarkable, the steps of soaking and slabbing could not be performed. In Comparative Example 3, the thermal crack in the slab was made large by the hot rolling, and the rolling was given up during roughing. In Comparative Example 4, the hot rolled coil was obtained. Although the coil was preheated in the rolling step by the reverse mill and the rolling temperature was 300° C., many breakages were made by cracks during recoiling and rolling and the rolling was given up at the half way point.

On the other hand, in the present invention, good high Si steel sheets of 0.5 mm$^t$ could be produced without any troubles. When the continuously cast slab for rolling the blank was used, the high Si thin steel sheet could be produced by the invention.

The grain diameters of the hot rolled sheets by the invention were 30 to 70 μm, whereas those of Comparative Example 4 were 200 to 300 μm.

EXAMPLE 2

In order to confirm the influences of elements other than Si, the ingot having the composition of Table 2 was made, and rolled under the conditions of the invention.

TABLE 2

| Steels | Si | Al | Mn | C | P | Balance |
|---|---|---|---|---|---|---|
| Invention Example | 6.5 | 1.0 | 0.3 | 0.1 | 0.08 | Fe & Impurities |
| Comparison Example | 6.5 | 2.5 | 0.6 | 0.25 | 0.15 | Fe & Impurities |

In the invention, although the sheet was more or less cracked at the edges in the thin sheet rolling procedure, rolling was possible to a thickness of 0.5 mm$^t$. In Comparative Examples, production was possible up to the hot rolled coil, but many cracks were generated in the rolling of the thin sheet, and rolling was given up at the half way point.

In the prior art, the production of high Si steel sheets was difficult, but in accordance with the present invention, they can be produced efficiently without causing any problems such as breakages of the coil during slabbing, hot rolling and thin sheet rolling, and it is possible to lower the processing temperature in the final warm rolling of the thin sheets, so that production cost may be lowered and stable operation can be accomplished.

INDUSTRIAL APPLICABILITY

By means of the present invention, it is possible to produce non-oriented high Si steel sheets of more than 4.0 wt % at high productivity on an industrial scale.

We claim:

1. A process for making non-oriented high Si steel sheet, comprising, making an ingot or continuously casting a piece of high Si steel composed of Si: 4.0 to 7.0 wt %, Al: not more than 2 wt %, Mn: not more than 0.5 wt %, C: not more than 0.2 wt %, P: not more than 0.1 wt %, and the rest being iron and inavoidable impurities;

introducing said solidified ingot or continuously cast piece as a slab into a slab heating furnace while the lowest-temperature part of said slab is not less than 600° C., heating said slab at a temperature of not more than 1250° C.;

rolling the slab at a temperature of not less than 600° C.;

introducing the slab into a hot rolling furnace while the lowest-temperature part of said slab is not less than 400° C., and sending the slab to a hot rolling process;

finish-rolling the slab such that the total rolling reduction at a temperature of not more than 900° C. is more than 30%, coiling the hot rolled steel at a temperature between 300° C. and 700° C., and rolling the hot rolled coil by a reverse mill at a temperature of not more than 400° C. to a thickness of not more than 0.5 m.

2. The process as claimed in claim 1, wherein the slab is heated at a temperature of not more than 1250° C. in the heating furnace.

3. A process for making non-oriented high Si steel sheet, comprising, continuously casting a piece of high Si steel composed of Si: 4.0 to 7.0 wt %, Al: not more than 2 wt %, Mn: not more than 0.5 wt %, C: not more than 0.2 wt %, P: not more than 0.1 wt %, and the rest being iron and inavoidable impurities;

introducing said solidified cast piece as a slab into a roll heating furnace while the lowest-temperature part of said solidified cast piece is not less than 600° C. and sending the heated piece to a hot rolling process;

finish-rolling the slab such that the total rolling reduction at a temperature of not more than 900° C. is more than 30%, coiling the hot rolled steel at a temperature between 300° C. and 700° C., and rolling the hot rolled coil by a reverse mill at a temperature of not more than 400° C. to a thickness of not more than 0.5 m.

4. The process as claimed in claim 3, wherein the piece is heated at a temperature of not more than 1250° C. in the heating furnace.

5. A process for making non-oriented high Si steel sheet, comprising, making an ingot or continuously casting a piece of high Si steel composed of Si: 4.0 to 7.0 wt %, Al: not more than 2 wt %, Mn: not more than 0.5 wt %, C: not more than 0.2 wt %, P: not more than 0.1 wt % and the rest being iron and inavoidable impurities;

introducing said solidified ingot or continuously cast piece as a slab into a slab heating furnace while the lowest-temperature part of said slab is not less than 600° C., heating said slab at a temperature of not more than 1250° C.;

rolling the slab at a temperature of not less than 600° C.;

directly transferring the slab to a hot rolling process while the lowest temperature part of said slab is not less than 400° C.;

finish-rolling the slab such that total rolling reduction at a temperature of not more than 900° C. is more than 30%, coiling the hot rolled steel at a temperature between 300° C. and 700° C., and rolling the hot rolled coil by a reverse mill at a temperature of not more than 400° C. to a thickness of not more than 0.5 m.

6. A process for making non-oriented high Si steel sheet, comprising, making an ingot or continuously casting a piece of high Si steel composed of Si: 4.0 to 7.0 wt %, Al: not more than 2 wt %, Mn: not more than 0.5 wt %, C: not more than 0.2 wt %, P: not more than 0.1 wt % and the rest being iron and inavoidable impurities;

directly transferring said solidified ingot or continuously cast piece as a slab into a slabbing process while the lowest-temperature part of said slab is not less than 600° C.;

rolling the slab at a temperature of not less than 600° C.;

introducing the slab into a hot rolling furnace while the lowest temperature part of said slab is not less than 400° C., and sending the slab to the hot rolling process;

finish-rolling the slab such that the total rolling reduction at a temperature of not more than 900° C. is more than 30%, coiling the hot rolled steel at a temperature between 300° C. and 700° C., and rolling the hot rolled coil by a reverse mill at a temperature of not more than 400° C. to a thickness of not more than 0.5 mm.

7. A process for making non-oriented high Si steel sheet, comprising, making an ingot or continuously casting a piece of high Si steel composed of Si: 4.0 to 7.0 wt %, Al: not more than 2 wt %, Mn: not more than 0.5 wt %, C: not more than 0.2 wt %, P: not more than 0.1 wt % and the rest being iron and inavoidable impurities;

directly transferring said solidified ingot or continuously cast piece as a slab into a slabbing process while the lowest-temperature part of said slab is not less than 600° C.;

rolling the slab at a temperature of not less than 600° C.;

directly transferring the slab to a hot rolling process while the lowest temperature part of said slab is not less than 400° C.;

finish-rolling the slab such that the total rolling reduction at a temperature of not more than 900° C. is more than 30%, coiling the hot rolled steel at a temperature between 300° C. and 700° C., and rolling the hot rolled coil by a reverse mill at a temperature of not more than 400° C. to a thickness of not more than 0.5 mm.

8. A process for making non-oriented high Si steel sheet, comprising, continuously casting a piece of high Si steel composed of Si: 4.0 to 7.0 wt %, Al: not more than 2 wt %, Mn: not more than 0.5 wt %, C: not more than 0.2 wt %, P: not more than 0.1 wt % and the rest being iron and inavoidable impurities;

directly transferring said solidified cast piece to a hot rolling process while the lowest-temperature part of said solidified cast piece is not less than 600° C.;

finish-rolling the slab such that total rolling reduction at a temperature of not more than 900° C. is more than 30%, coiling the hot rolled steel at a temperature between 300° C. and 700° C., and rolling the hot rolled coil by a reverse mill at a temperature of not more than 400° C. to a thickness of not more than 0.5 mm.

* * * * *